US008113356B2

(12) United States Patent
Burnett

(10) Patent No.: US 8,113,356 B2
(45) Date of Patent: Feb. 14, 2012

(54) SYSTEMS AND METHODS FOR THE RECOVERY OF LOST CIRCULATION AND SIMILAR MATERIAL

(75) Inventor: George Alexander Burnett, Aberdeen (GB)

(73) Assignee: National Oilwell Varco L.P., Houston, TX (US)

( * ) Notice: Subject to any disclaimer, the term of this patent is extended or adjusted under 35 U.S.C. 154(b) by 588 days.

(21) Appl. No.: 12/287,709

(22) Filed: Oct. 10, 2008

(65) Prior Publication Data

US 2010/0089802 A1 Apr. 15, 2010

(51) Int. Cl.
*B07B 1/28* (2006.01)

(52) U.S. Cl. ..... 209/315; 209/360

(58) Field of Classification Search ..... 209/311, 209/314, 315, 360

See application file for complete search history.

(56) References Cited

U.S. PATENT DOCUMENTS

| | | | | |
|---|---|---|---|---|
| 1,886,174 | A | 11/1932 | Flint et al. | 209/269 |
| 2,082,513 | A | 6/1937 | Roberts | 210/76 |
| 1,830,792 | A | 11/1937 | Herrmann | 209/401 |
| 2,112,784 | A | 3/1938 | McNitt | 99/105 |
| 2,418,529 | A | 4/1947 | Stern | 51/309 |
| 2,653,521 | A | 9/1953 | Alhfors | 209/270 |
| 2,895,669 | A | 7/1959 | Bobo | 494/10 |
| 2,928,546 | A | 3/1960 | Church | 210/319 |
| 2,942,731 | A | 6/1960 | Soldini | 209/293 |
| 2,955,753 | A | 10/1960 | O'Conor et al. | 494/5 |
| 2,961,154 | A | 11/1960 | Bergey | 494/1 |
| 3,012,674 | A | 12/1961 | Hoppe | 209/401 |
| 3,064,806 | A | 11/1962 | Hukki | 209/17 |
| 3,070,291 | A | 12/1962 | Bergey | 494/1 |
| 3,302,720 | A | 2/1967 | Brandon | 166/42 |
| 3,640,344 | A | 2/1972 | Brandon | 166/307 |
| 3,796,299 | A | 3/1974 | Musschoot | 198/220 |
| 3,855,380 | A | 12/1974 | Gordon et al. | 264/97 |
| 3,874,733 | A | 4/1975 | Poundstone et al. | 299/17 |
| 3,900,393 | A | 8/1975 | Wilson | 209/399 |
| 3,993,146 | A | 11/1976 | Poundstone et al. | 175/206 |
| 4,033,865 | A | 7/1977 | Derrick, Jr. | 209/275 |
| 4,038,152 | A | 7/1977 | Atkins | 201/2.5 |
| 4,192,743 | A | 3/1980 | Bastgen et al. | 210/712 |

(Continued)

FOREIGN PATENT DOCUMENTS

DE 4127929 A1 2/1993

(Continued)

OTHER PUBLICATIONS

U.S. Appl. No. 12/481,959 Final Office Action dated Oct. 27, 2010.

(Continued)

*Primary Examiner* — Joseph C Rodriguez
*Assistant Examiner* — Kalyanavenka Teshware Kumar
(74) *Attorney, Agent, or Firm* — Williams, Morgann & Amerson, P.C.

(57) ABSTRACT

Methods and systems are disclosed employing a quad-tier shale shaker for processing a mixture of drilling fluid and solids which solids include, in one aspect, lost circulation material (and/or material of size similar to the size of the lost circulation material). This abstract is provided to comply with the rules requiring an abstract which will allow a searcher or other reader to quickly ascertain the subject matter of the technical disclosure and is submitted with the understanding that it will not be used to interpret or limit the scope or meaning of the claims, 37 C.F.R. 1.72(b).

26 Claims, 11 Drawing Sheets

U.S. PATENT DOCUMENTS

| | | | | |
|---|---|---|---|---|
| 4,222,988 | A | 9/1980 | Barthel | 422/309 |
| 4,233,181 | A | 11/1980 | Goller et al. | 252/425.3 |
| 4,306,974 | A | 12/1981 | Harry | 210/388 |
| 4,322,288 | A | 3/1982 | Schmidt | 209/356 |
| 4,350,591 | A | 9/1982 | Lee | 210/384 |
| 4,411,074 | A | 10/1983 | Daly | 34/32 |
| 4,446,022 | A | 5/1984 | Harry | 210/388 |
| 4,459,207 | A | 7/1984 | Young | 209/269 |
| 4,482,459 | A | 11/1984 | Shiver | 210/639 |
| 4,495,065 | A | 1/1985 | DeReamer et al. | 209/243 |
| 4,526,687 | A | 7/1985 | Nugent | 210/202 |
| 4,536,286 | A | 8/1985 | Nugent | 210/202 |
| 4,575,336 | A | 3/1986 | Mudd et al. | 432/72 |
| 4,624,417 | A | 11/1986 | Gangi | 241/17 |
| 4,639,258 | A | 1/1987 | Schellstede et al. | 95/260 |
| 4,650,687 | A | 3/1987 | Willard et al. | 426/438 |
| 4,696,353 | A | 9/1987 | Elmquist et al. | 175/206 |
| 4,696,751 | A | 9/1987 | Eifling | 210/780 |
| 4,729,548 | A | 3/1988 | Sullins | 266/44 |
| 4,751,887 | A | 6/1988 | Terry et al. | 110/246 |
| 4,770,711 | A | 9/1988 | Deal, III et al. | 134/18 |
| 4,783,057 | A | 11/1988 | Sullins | 266/44 |
| 4,791,002 | A | 12/1988 | Baker et al. | 426/641 |
| 4,799,987 | A | 1/1989 | Sullins | 156/425 |
| 4,809,791 | A | 3/1989 | Hayatdavoudi | 175/40 |
| 4,832,853 | A | 5/1989 | Shiraki et al. | 210/781 |
| 4,844,106 | A | 7/1989 | Hunter et al. | 134/73 |
| 4,882,054 | A | 11/1989 | Derrick et al. | 210/389 |
| 4,889,733 | A | 12/1989 | Willard et al. | 426/438 |
| 4,889,737 | A | 12/1989 | Willard et al. | 426/550 |
| 4,895,665 | A | 1/1990 | Colelli et al. | 210/710 |
| 4,895,731 | A | 1/1990 | Baker et al. | 426/641 |
| 4,896,835 | A | 1/1990 | Fahrenholz | 241/74 |
| 4,915,452 | A | 4/1990 | Dibble | 299/17 |
| 4,942,929 | A | 7/1990 | Malachosky et al. | 175/66 |
| 5,053,082 | A | 10/1991 | Flanigan et al. | 134/25.1 |
| 5,066,350 | A | 11/1991 | Sullins | 156/187 |
| 5,080,721 | A | 1/1992 | Flanigan et al. | 134/26 |
| 5,107,874 | A | 4/1992 | Flanigan et al. | 134/60 |
| 5,109,933 | A | 5/1992 | Jackson | 175/66 |
| 5,129,469 | A | 7/1992 | Jackson | 175/66 |
| 5,145,256 | A | 9/1992 | Wiemers et al. | 366/336 |
| 5,181,578 | A | 1/1993 | Lawler | 175/424 |
| 5,190,645 | A | 3/1993 | Burgess | 210/144 |
| 5,200,372 | A | 4/1993 | Kuroyama et al. | 501/96 |
| 5,221,008 | A | 6/1993 | Derrick, Jr. et al. | 209/269 |
| 5,227,057 | A | 7/1993 | Lundquist | 210/174 |
| 5,253,718 | A | 10/1993 | Lawler | 175/20 |
| 5,314,058 | A | 5/1994 | Graham | 198/753 |
| 5,337,966 | A | 8/1994 | Francis et al. | 241/46.06 |
| 5,385,669 | A | 1/1995 | Leone, Sr. | 210/488 |
| 5,392,925 | A | 2/1995 | Seyffert | 209/405 |
| 5,454,957 | A | 10/1995 | Roff | 210/768 |
| 5,488,104 | A | 1/1996 | Schulz | 536/86 |
| 5,489,204 | A | 2/1996 | Conwell et al. | 432/153 |
| 5,494,584 | A | 2/1996 | McLachlan et al. | 210/739 |
| 5,516,348 | A | 5/1996 | Conwell et al. | 51/309 |
| 5,534,207 | A | 7/1996 | Burrus | 264/150 |
| 5,547,479 | A | 8/1996 | Conwell et al. | 51/309 |
| 5,566,889 | A | 10/1996 | Preiss | 241/19 |
| 5,567,150 | A | 10/1996 | Conwell et al. | 432/14 |
| 5,570,749 | A | 11/1996 | Reed | 175/66 |
| 5,669,941 | A | 9/1997 | Peterson | 51/295 |
| 5,732,828 | A | 3/1998 | Littlefield, Jr. | 209/365.1 |
| 5,791,494 | A | 8/1998 | Meyer | 209/368 |
| 5,819,952 | A | 10/1998 | Cook et al. | 209/400 |
| 5,839,521 | A | 11/1998 | Dietzen | 100/37 |
| 5,868,125 | A | 2/1999 | Maoujoud | 125/15 |
| 5,896,998 | A | 4/1999 | Bjorklund et al. | 209/326 |
| 5,944,197 | A | 8/1999 | Baltzer et al. | 209/400 |
| 5,971,307 | A | 10/1999 | Davenport | 241/259.1 |
| 6,013,158 | A | 1/2000 | Wootten | 202/99 |
| 6,024,228 | A | 2/2000 | Williams | 209/272 |
| 6,045,070 | A | 4/2000 | Davenport | 241/60 |
| 6,102,310 | A | 8/2000 | Davenport | 241/21 |
| 6,138,834 | A | 10/2000 | Southall | 209/17 |
| 6,155,428 | A | 12/2000 | Bailey et al. | 209/315 |
| 6,161,700 | A | 12/2000 | Bakula | 209/401 |
| 6,170,580 | B1 | 1/2001 | Reddoch | 175/66 |
| 6,223,906 | B1 | 5/2001 | Williams | 210/400 |
| 6,234,250 | B1 | 5/2001 | Green et al. | 166/250.03 |
| 6,279,471 | B1 | 8/2001 | Reddoch | 100/37 |
| 6,283,302 | B1 | 9/2001 | Schulte et al. | 209/399 |
| 6,333,700 | B1 | 12/2001 | Thomeer et al. | 340/854.8 |
| 6,352,159 | B1 | 3/2002 | Loshe | 209/268 |
| 6,399,851 | B1 | 6/2002 | Siddle | 203/87 |
| 6,506,310 | B2 | 1/2003 | Kulbeth | 210/780 |
| 6,510,947 | B1 | 1/2003 | Schulte et al. | 210/388 |
| 6,662,952 | B2 | 12/2003 | Adams et al. | 209/319 |
| 6,669,027 | B1 | 12/2003 | Mooney et al. | 209/405 |
| 6,763,605 | B2 | 7/2004 | Reddoch | 34/58 |
| 6,783,088 | B1 | 8/2004 | Gillis et al. | 241/19 |
| 6,793,814 | B2 | 9/2004 | Fout et al. | 210/188 |
| 6,863,809 | B2 | 3/2005 | Smith et al. | 210/202 |
| 6,868,972 | B2 | 3/2005 | Seyffert et al. | 209/254 |
| 6,926,101 | B2 | 8/2005 | deBoer | 175/70 |
| 7,093,678 | B2 | 8/2006 | Risher et al. | 175/66 |
| 7,144,516 | B2 | 12/2006 | Smith | 210/803 |
| 7,195,084 | B2 | 3/2007 | Burnett et al. | 175/66 |
| 7,284,665 | B2 | 10/2007 | Fuchs | 209/270 |
| 7,303,079 | B2 | 12/2007 | Reid-Robertson et al. | 209/405 |
| 7,306,057 | B2 | 12/2007 | Strong et al. | 175/66 |
| 7,316,321 | B2 | 1/2008 | Robertson et al. | 209/400 |
| 7,337,860 | B2 | 3/2008 | McIntyre | 175/66 |
| 7,373,996 | B1 | 5/2008 | Martin et al. | 175/206 |
| 7,514,011 | B2 | 4/2009 | Kulbeth | 210/780 |
| 7,540,837 | B2 | 6/2009 | Scott et al. | 494/7 |
| 7,540,838 | B2 | 6/2009 | Scott et al. | 494/7 |
| 7,581,569 | B2 | 9/2009 | Beck | 139/425 R |
| 7,770,665 | B2 | 8/2010 | Eia et al. | 175/66 |
| 2001/0032815 | A1 | 10/2001 | Adams et al. | 210/388 |
| 2002/0000399 | A1 | 1/2002 | Winkler et al. | 209/399 |
| 2002/0033278 | A1 | 3/2002 | Reddoch | 175/57 |
| 2002/0134709 | A1 | 9/2002 | Riddle | 209/238 |
| 2004/0040746 | A1 | 3/2004 | Niedermayr et al. | 175/38 |
| 2004/0051650 | A1 | 3/2004 | Gonsoulin et al. | 340/853.1 |
| 2004/0156920 | A1 | 8/2004 | Kane | 424/725 |
| 2004/0245155 | A1 | 12/2004 | Strong et al. | 209/405 |
| 2005/0236305 | A1 | 10/2005 | Schulte et al. | 209/403 |
| 2006/0019812 | A1 | 1/2006 | Stalwick | 494/42 |
| 2006/0034988 | A1 | 2/2006 | Bresnahan et al. | 426/502 |
| 2006/0102390 | A1 | 5/2006 | Burnett et al. | 175/66 |
| 2006/0105896 | A1 | 5/2006 | Smith et al. | 494/7 |
| 2006/0144779 | A1* | 7/2006 | Bailey | 210/330 |
| 2007/0108106 | A1* | 5/2007 | Burnett | 209/325 |
| 2007/0131592 | A1* | 6/2007 | Browne et al. | 209/399 |
| 2008/0078704 | A1 | 4/2008 | Carr et al. | 209/399 |
| 2008/0179090 | A1 | 7/2008 | Eia et al. | 175/5 |
| 2008/0179096 | A1 | 7/2008 | Eia et al. | 175/66 |
| 2008/0179097 | A1 | 7/2008 | Eia et al. | 175/66 |
| 2009/0178978 | A1 | 7/2009 | Beebe et al. | 210/747 |
| 2009/0286098 | A1 | 11/2009 | Yajima et al. | 428/507 |
| 2009/0316084 | A1 | 12/2009 | Yajima et al. | 349/96 |
| 2010/0084190 | A1 | 4/2010 | Eia et al. | 175/5 |
| 2010/0119570 | A1 | 5/2010 | Potter et al. | 424/422 |

FOREIGN PATENT DOCUMENTS

| | | |
|---|---|---|
| FR | 2 611 559 | 9/1988 |
| FR | 2 636 669 | 3/1990 |
| GB | 2 030 482 A | 4/1980 |
| GB | 2 327 442 A | 1/1999 |
| JP | 55112761 | 8/1980 |
| JP | 59069268 | 4/1984 |
| JP | 63003090 | 1/1988 |
| JP | 63283860 | 11/1988 |
| JP | 63290705 | 11/1988 |
| JP | 02127030 | 5/1990 |
| JP | 02167834 | 6/1990 |
| JP | 03240925 | 10/1991 |
| JP | 03264263 | 11/1991 |
| JP | 04093045 | 3/1992 |
| JP | 04269170 | 9/1992 |
| JP | 05043884 | 2/1993 |
| JP | 05301158 | 11/1993 |
| JP | 06063499 | 3/1994 |
| JP | 07304028 | 11/1995 |
| JP | 08039428 | 2/1996 |

| | | |
|---|---|---|
| JP | 08270355 | 10/1996 |
| JP | 09109032 | 4/1997 |
| WO | WO98/10895 | 3/1998 |

OTHER PUBLICATIONS

U.S. Appl. No. 12/481,959 Office Action dated Jun. 7, 2010.
U.S. Appl. No. 12/469,851 Final Office Action dated Nov. 9, 2010.
U.S. Appl. No. 12/469,851 Office Action dated Jun. 28, 2010.
U.S. Appl. No. 12/287,716 Office Action dated Jun. 17, 2011.
U.S. Appl. No. 12/228,670 Office Action dated Jun. 20, 2011.
U.S. Appl. No. 12/227,462 Final Office Action dated May 26, 2011.
U.S. Appl. No. 12/227,462 Office Action dated Nov. 15, 2010.
U.S. Appl. No. 12/008,980 Office Action dated Apr. 5, 2011.
U.S. Appl. No. 12/001,479 Office Action dated Jun. 8, 2011.
U.S. Appl. No. 11/897,976 Final Office Action dated Sep. 1, 2010.
U.S. Appl. No. 11/897,976 Office Action dated Apr. 1, 2010.
U.S. Appl. No. 11/897,975 Final Office Action dated Jul. 21, 2010.
U.S. Appl. No. 11/897,975 Office Action dated Feb. 19, 2010.
U.S. Appl. No. 11/897,975 Final Office Action dated Mar. 1, 2011.
U.S. Appl. No. 11/637,615 Final Office Action dated Aug. 2, 2010.
U.S. Appl. No. 11/637,615 Office Action dated Mar. 2, 2010.
Polyamide 6/6—Nylon 6/6—PA 6/6 60% Glass Fibre Reinforced, Data Sheet [online], AZoM™, The A to Z of Materials and AZojomo, The "AZo Journal of Materials Online" [retrieved on Nov. 23, 2005] (2005) (Retrieved from the Internet: <URL: http://web.archive.org/web/20051123025735/http://www.azom.com/details.asp?ArticleID=493>.

* cited by examiner

SYSTEMS AND METHODS FOR THE RECOVERY OF LOST CIRCULATION AND SIMILAR MATERIAL

BACKGROUND OF THE INVENTION

1. Field Of The Invention

The present invention is directed to drilling fluid processing systems; shale shakers; to methods for using these things; and, in certain particular aspects, to the separation of lost circulation material from used drilling fluid.

2. Description of Related Art

In the oil and gas industries, shale shakers use screens to treat drilling fluid contaminated with undesirable solids. Typically such apparatuses have a basket, deck, or other screen holding or mounting structure mounted in or over a receiving receptacle or tank and vibrating apparatus for vibrating one or more screens. Material to be treated is introduced to the screen(s) either by flowing it directly onto the screen(s) or by flowing it into a container, tank, or "possum belly" from which it then flows to the screen(s). Often, the screen or screens used to treat material is sealed in place on a screen deck, in a screen basket, or on screen mounting structure.

In the past it has been common to use multiple screens at multiple levels in a shale shaker to process drilling fluid, e.g., screens at one, two or three levels.

"Lost circulation" of drilling fluid occurs when, in drilling a wellbore, the circulation of drilling fluid to and then away from the drill bit ceases due to the porosity of the formation and/or due to fracturing of the formation through which the wellbore is being drilled. When lost circulation occurs, drilling fluid is pumped into the fractured formation rather than being returned to the surface. Often circulation is lost at some specific depth where the formation is "weak", and that the fracture extends horizontally away from the borehole. Expressions used to describe rocks that are susceptible to lost returns include terms like vugular limestone, unconsolidated sand, "rotten" shale, and the like.

A wide variety of "lost circulation materials" ("LCM") have been pumped into wellbores to fill or seal off a porous formation or to fill or seal off a wellbore fracture so that a proper route for drilling fluid circulation is re-established. Often lost circulation materials are generally be divided into fibers, flakes, granules, and mixtures.

Often it is also desirable to recover and retain the lost circulation material in the drilling mud system during continuous circulation. Screening the drilling mud for removal of undesired particulate-matter can also result in removal of the lost circulation material and, therefore, require continuous introduction of new lost circulation material to the drilling mud downstream of the mud screening operation.

The addition of lost circulation material compounds the separating problems because it, like the drilling fluid, is preferably cleaned and recirculated. Exiting the well is the drilling fluid of small size, the lost circulation material of a large size, and the undesirable material of a size therebetween, with the largest and smallest of the materials to be recirculated. One proposed solution to this separation problem is a conventional two step screening process as shown in U.S. Pat. No. 4,116,288. There the exiting mixture of drilling fluid, lost circulation material and undesirable material is first subjected to a coarse screening to separate the lost circulation material from the drilling fluid and undesirable material which drops to a second finer screen therebelow to separate the drilling fluid from the undesirable material. The drilling fluid and lost circulation material are then reunited for recirculation into the well. This system is susceptible to height restrictions and fine screen problems. The lost circulation material can be coated with undesirable material which will not go through a first screen, moves over and exits off of the top side of the first screen, and is circulated back into a well.

There are a variety of known drilling fluid processing systems, shale shakers, and methods for recovery of lost circulation material; including, for example, but not limited to, those in U.S. Pat. Nos. 6,868,972; 6,669,027; 6,662,952; 6,352,159; 6,510,947; 5,861,362; 5,392,925; 5,229,018; 4,696,353; 4,459,207; 4,495,065; 4,446,022; 4,306,974; 4,319,991; and 4,116,288 (all said patents incorporated fully herein for all purposes).

In certain prior systems, problems have been encountered with systems for screening out lost circulation material when undesirable material of the same size is also screened out.

BRIEF SUMMARY OF THE INVENTION

The present invention discloses, in certain aspects, methods and systems for processing drilling fluid to recover components thereof and, in one particular aspect for separating lost circulation material (or lost circulation material along with solids of similar size) from used drilling fluid. In certain aspects, the separated lost circulation material is recovered and used.

In certain particular aspects, such methods and systems employs a novel shale shaker according to the present invention with screening apparatus below an initial scalper screen apparatus for separating lost circulation material (and/or material of similar size) from used drilling fluid.

A vibratory separator or shale shaker, in one embodiment according to the present invention has a screen or screens at separate levels as described herein according to the present invention. In one particular aspect, two lowermost screens can receive flow from a higher screen in parallel or in series. The present invention, in certain embodiments, includes a vibratory separator or shale shaker with a base or frame; a "basket" or screen mounting apparatus on or in the base or frame; screens at three or four different, spaced-apart distinct levels according to the present invention; vibrating apparatus; and a collection tank or receptacle. Such a shale shaker can treat drilling fluid contaminated with solids, e.g. cuttings, debris, etc.; and drilling fluid with lost circulation material (and/or material of similar size) therein. Such a shale shaker, in certain aspects, provides a separate exit stream from a second screening level which is primarily lost circulation material (and/or material of similar size).

Accordingly, the present invention includes features and advantages which are believed to enable it to advance the processing of drilling fluid with lost circulation material (and/or material of similar size) therein. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide the embodiments and aspects listed above and:

New, useful, unique, efficient, nonobvious drilling fluid processing systems; shale shakers; and methods of the use of these systems and shakers; and Such shale shakers with screens at four levels according to the present invention with the last two screens operating in series or in parallel; and New, useful, unique, efficient, nonobvious drilling fluid processing systems and shale shakers; and methods of their use for separating and recovering lost circulation material (and/or material of similar size) from spent drilling fluid.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

Certain aspects, certain embodiments, and certain preferable features of the invention are set out herein. Any combination of aspects or features shown in any aspect or embodiment can be used except where such aspects or features are mutually exclusive.

BRIEF DESCRIPTION OF THE SEVERAL VIEWS OF THE DRAWING

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

Figure 1:
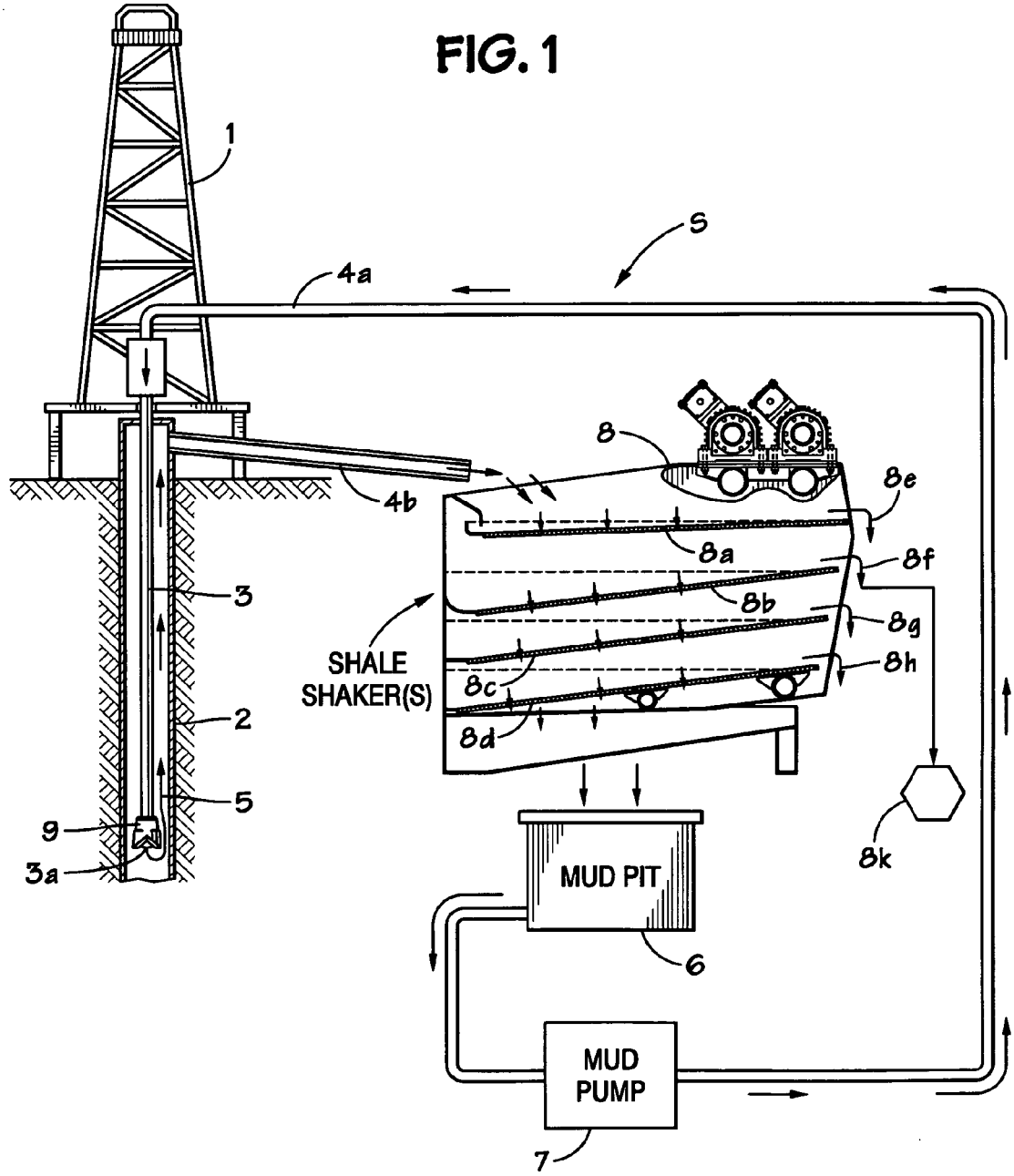
FIG. 1 is a schematic view of a system according to the present invention.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

FIG. 1 illustrates a system S according to the present invention which includes a derrick 1 that extends vertically over a wellbore 2. A tubular work string 3 extends into the wellbore 2, and extends from the earth's surface to a desired depth within the wellbore. A flow line 4*a* is connected to the tubular work string 3. A flow line 4*b* is connected to annular space 5 formed between the outer surface of tubular work string 3 and the inner surface of wellbore 2.

Drilling fluid (or "mud") for the system in a mud pit 6 is circulated through the overall mud system via a mud pump 7.

During typical drilling operations, fluid is pumped into the tubular work string 3 by the mud pump 7 through the flow line 4*a*, circulated out a bottom end 3*a* of the tubular work string 3 (e.g., but not limited to, out from a drill bit 9), up an annulus 5 of the wellbore 2, and out of the annulus 5 via the flow line 4*b*.

Spent (or used) fluid mud exiting the wellbore annulus 5 through the flow line 4*b* includes drilling fluid, drill cuttings, lost circulation material (and/or material of similar size), and other debris encountered in the wellbore 2. Accordingly, the spent drill cuttings mixture leaving the well is directed to a separation device, such as one or more shale shakers 8 according to the present invention. The combined mixture of drilling fluid, added material (e.g. solids and/or lost circulation material, etc.), debris, and drilled cuttings are directed to the shale shakers 8. Liquid drilling fluid passes through screens 8*a*, 8*b*, 8*c*, 8*d* which are at four different levels of the shale shakers 8 and is directed into the mud pit 6 (or the two lowermost screens are at the same level each receiving a portion of flow from the screen 8*b*). Drill cuttings and other solids pass over the screens 8*a*-8*d* of the shale shakers 8 and are discharged (arrows 8*e*, 8*f*, 8*h*). With the proper selection of screen mesh for the screen 8*b*, lost circulation material (with some material of similar size, if present) is separated by and discharged from the top of the screen 8*b* (see arrow 8*f*). The recovered lost circulation material (and/or material of similar size) flows and/or is pumped to a reservoir or to a further processing apparatus 8*k*. Optionally, the shale shakers 8 are like any other shale shaker disclosed herein according to the present invention.

Figure 1A:
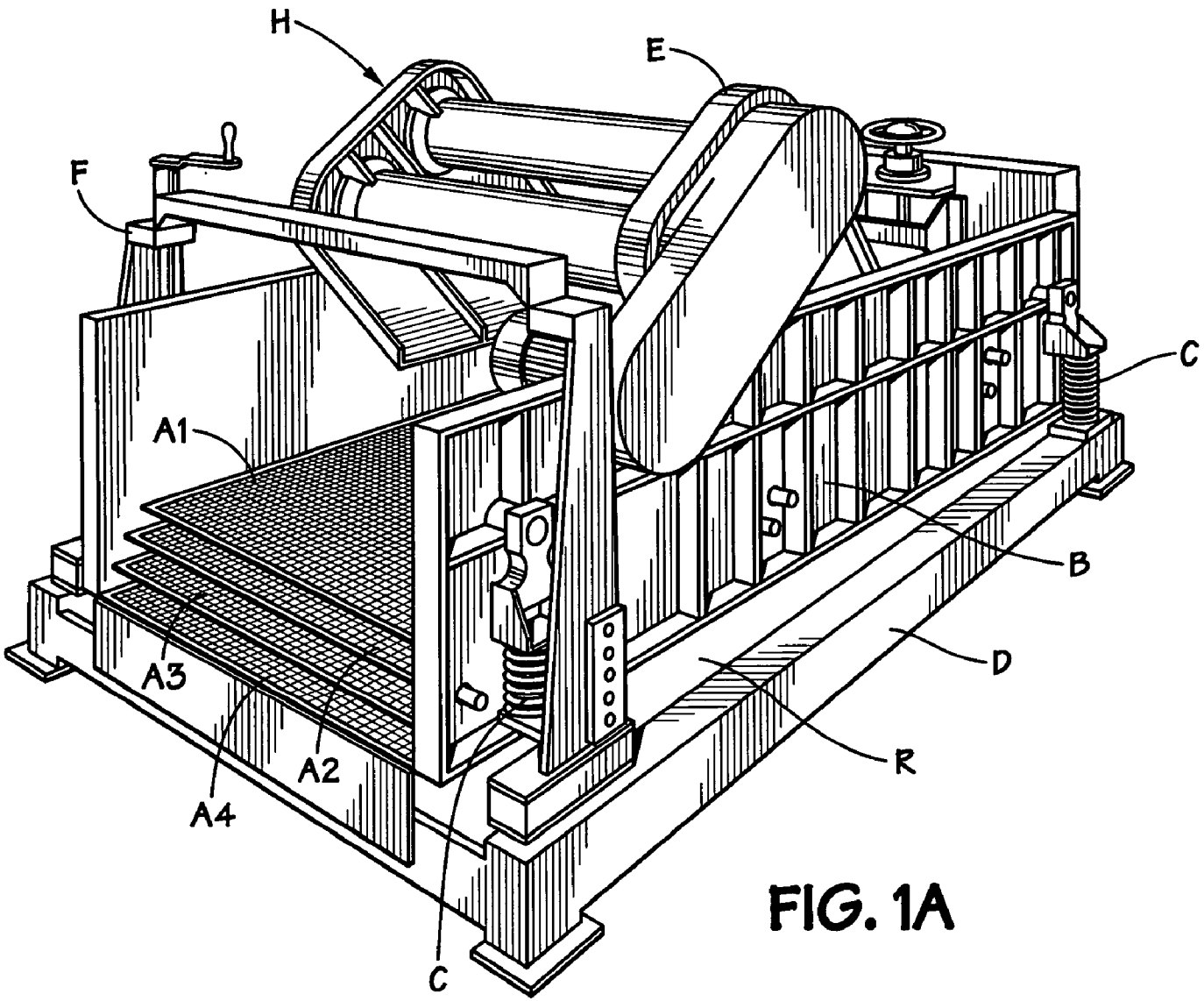
FIG. 1A is a perspective view of a shale shaker according to the present invention.

Referring now to FIG. 1A, a shale shaker H according to the present invention has screens A1, A2, A3, A4, each of which is, according to the present invention, at one of four different levels (with screen or screening cloth or mesh as desired). The screens are mounted on vibratable screen mounting apparatus or "basket" B. The screens A1, A2, A3, A4, according to the present invention, may be any suitable known screen or screens, with the screen A2 (or the screens A2 and A3) used to separate lost circulation material (and/or material of similar size). The basket B is mounted on springs C (only two shown; two as shown are on the opposite side) which are supported from a frame D. The basket B is vibrated by a motor and interconnected vibrating apparatus E which is mounted on the basket B for vibrating the basket and the screens. Elevator apparatus F provides for raising and lowering of the basket end. Fluid passing through the screens A1, A2, A3, A4 flows into a receptacle R beneath the bottom screen A4. In certain aspects screen A1 has the coarsest mesh of all the screens and acts as a scalping screen and the screens A3 and A4 provide fine screening. The exit feeds from the top sides of the screens A1, A3, A4 may go to disposal or may be directed as described below for any embodiment of the present invention. The lost circulation material recovered from the top of the screen A2 (or, optionally, from the tops of the screens A2 and A3) may be flowed, processed and treated as described for any embodiment of the present invention. As shown, the screens A3, A4 operate in series, i.e., the underflow from the screen A3 flows down to the screen A4. Optionally, the screens A3, A4 may be operated in parallel with each receiving a portion of screen A2's underflow.

Figure 2A:
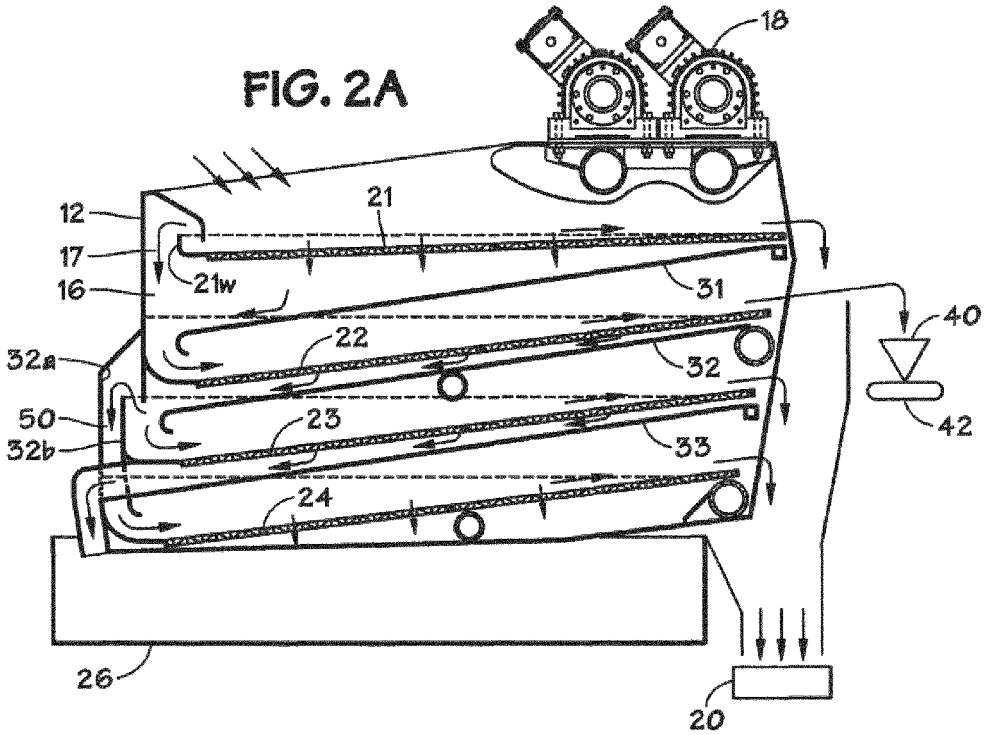
FIG. 2A is a side view, partially in cross-section, of a shale shaker according to the present invention.
Figure 2B:
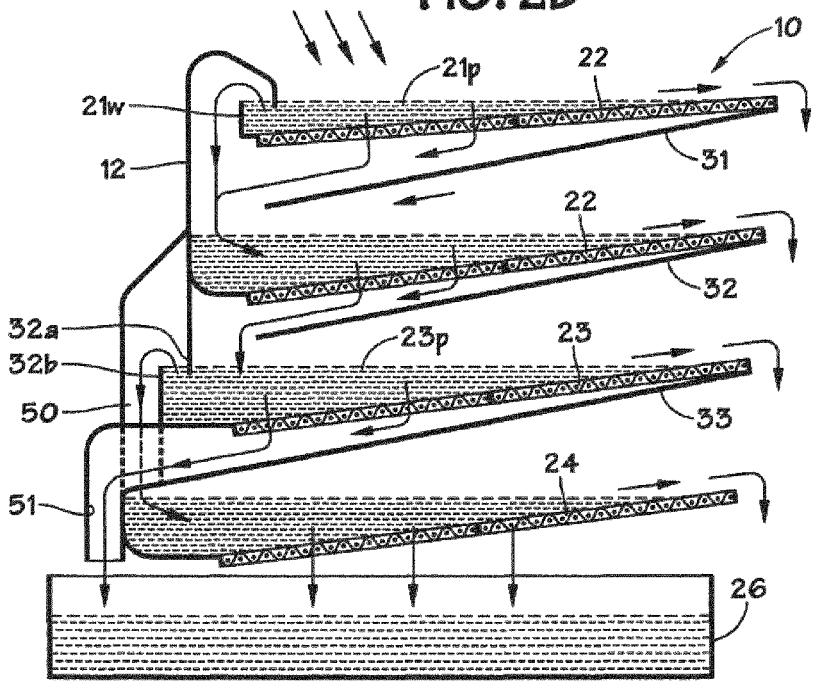
FIG. 2B is a cross-sectional view of the screens and related structure of the shale shaker of FIG. 2A.

FIGS. 2A and 2B show a system 10 according to the present invention which includes a shale shaker 12 with a base 14 and a screen-supporting basket 16. A vibrator apparatus 18 vibrates the basket 16 and screens mounted in it.

Four spaced-apart screens 21-24 are mounted in the basket 16 at different levels (e.g. spaced-apart six to eight inches) or put another way, at four different heights in the basket. In one particular embodiment the screen 21 is a scalping screen which, in one particular aspect removes relatively large pieces of material, e.g. with mesh sized so that pieces ⅛" and 1/64" is used. In one aspect, the screen 21 has a mesh size such that pieces greater than 1/16" are removed (and pieces of, among other things, solids and/or lost circulation material that are 1/16" or smaller in largest dimension pass through the screen 21 (e.g., but not limited to graphite ball lost circulation material that are 1/16" in largest dimension or slightly smaller).

The screen 22 has a mesh size as chosen for removing material of a certain largest dimension or larger, including, but not limited to solids, debris, drilled cuttings, desirable additives, and/or lost circulation material. In one aspect the mesh size is chosen in cooperation with the mesh size of the screen 21 so that the screen 22 removes lost circulation material (and solids or pieces of similar size) and, in one particular aspect the mesh size is chosen so that lost circulation material of a largest dimension of 1/16" or greater does not pass through the screen 22 and flows from the top thereof In one aspect such lost circulation material is graphite balls.

The screens 23 and 24 further filter out solids from the flow through the screen 22 and, in certain aspects, the screens 23 and 24 act as typical standard fine screening screens used to process a mixture of drilling fluid and solids.

The exit streams from screens 21, 23, and 24 exit from the tops of their respective screens and flow down to a container, system or apparatus 20 for storage and/or further processing. Drilling fluid flowing through the screens flows down to a sump or container 26 and from there to a reservoir or in one aspect, back to an active rig mud system. The exit stream from the screen 22, in particular aspects, has wet lost circulation material (or wet lost circulation material along with solids of similar size) of at least 50% by volume; and in one particular aspect at least 75% lost circulation material by volume (in one example, the output is 50% lost circulation material and 50% solids of similar size). In certain aspects, screen mesh size is chosen so that a relatively large percentage of the flow off the top of the screen is lost circulation material, e.g. by volume, up to 50%, 75%, or up to 90%.

Fluid with some solids therein (including the lost circulation material of a certain size, if present) that flows through the screen 21 is directed to the screen 22 by a flowback barrier (or plate) 31. Optionally, the flowback barrier 31 is eliminated. The material (including lost circulation material of a certain size, if present) that exits from the top of the screen 22 is transferred to a reclamation system 40 (which, in one aspect, is, has or includes an auger apparatus 42 for moving solids to and/or from the reclamation apparatus).

Fluid with solids that flows through the screen 22 is directed to the screens 23 and 24 by a flowback barrier or plate 32, a flow channel 32*a*, and a weir 32*b*. Fluid with solids that flows through the screen 23 is directed to the sump 26 through a channel 51 by a flowback barrier 33 and a channel 33*a*. When the level of fluid (with material therein) exceeds the height of the weir 32*b*, part of the flow from the screen 22 flows into the flow channel 50 bypassing the screen 23 and flowing to the screen 24 (thus, the screens 23, 24 in this manner operate in parallel). Fluid flowing through the screen 24 flows into the sump 26. Optionally, the screen 21 includes an end weir 21*w* and fluid and material on top of the screen 21 in a pool 21*p* that exceeds the height of the weir 21*w* bypasses the screen 21 and flows to the screen 22 via a channel 17. The flowback barriers extend under substantially all of the surface of the particular screens under which they are located. Any one, two, or three of the flowback barriers can, optionally, be eliminated.

The screens 21-24 are at typical screen tilt angles, e.g. between 6 degrees to 12 degrees from the horizontal and in one aspect, about 8 degrees.

Figure 2C:
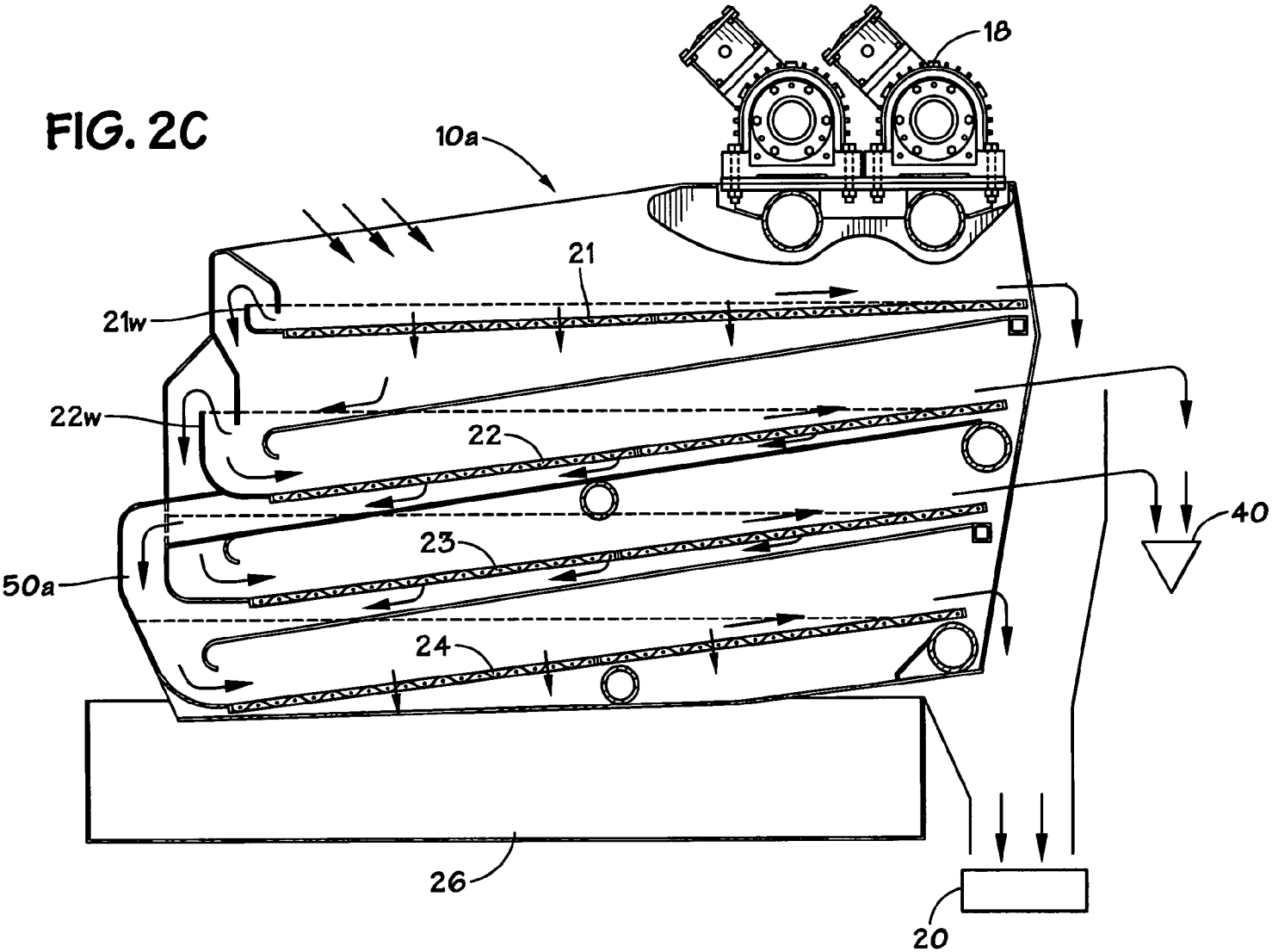
FIG. 2C is a cross-sectional view of a shale shaker according to the present invention.

A shale shaker 10a shown in FIG. 2C is like the system 10, FIG. 2A (and like numerals indicate like parts). Two screens, the screens 22 and 23, are used in the shale shaker 10*a* to remove LCM material (and/or material of similar size) . The two screens 22, 23 act in parallel with flow from the upper screen 21 flowing both to the screen 22 and, over a weir 22*w*, to the screen 23. Fluid flowing through the screen 22 flows to a channel 50*a* and then down to the screen 24 as does fluid flowing through the screen 23.

Figure 3A:
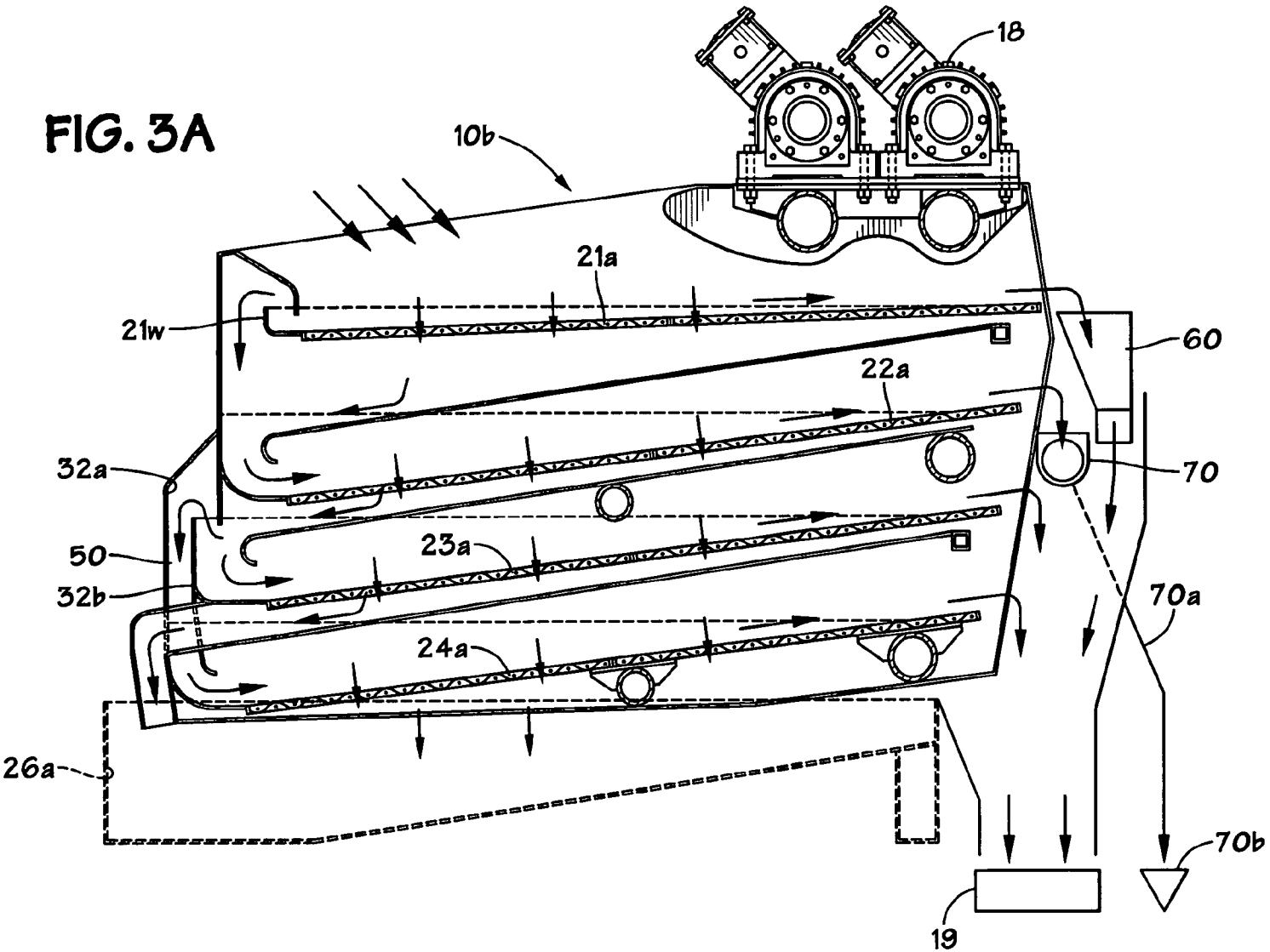
FIG. 3A is a side cutaway view of a shale shaker according to the present invention.
Figure 3B:
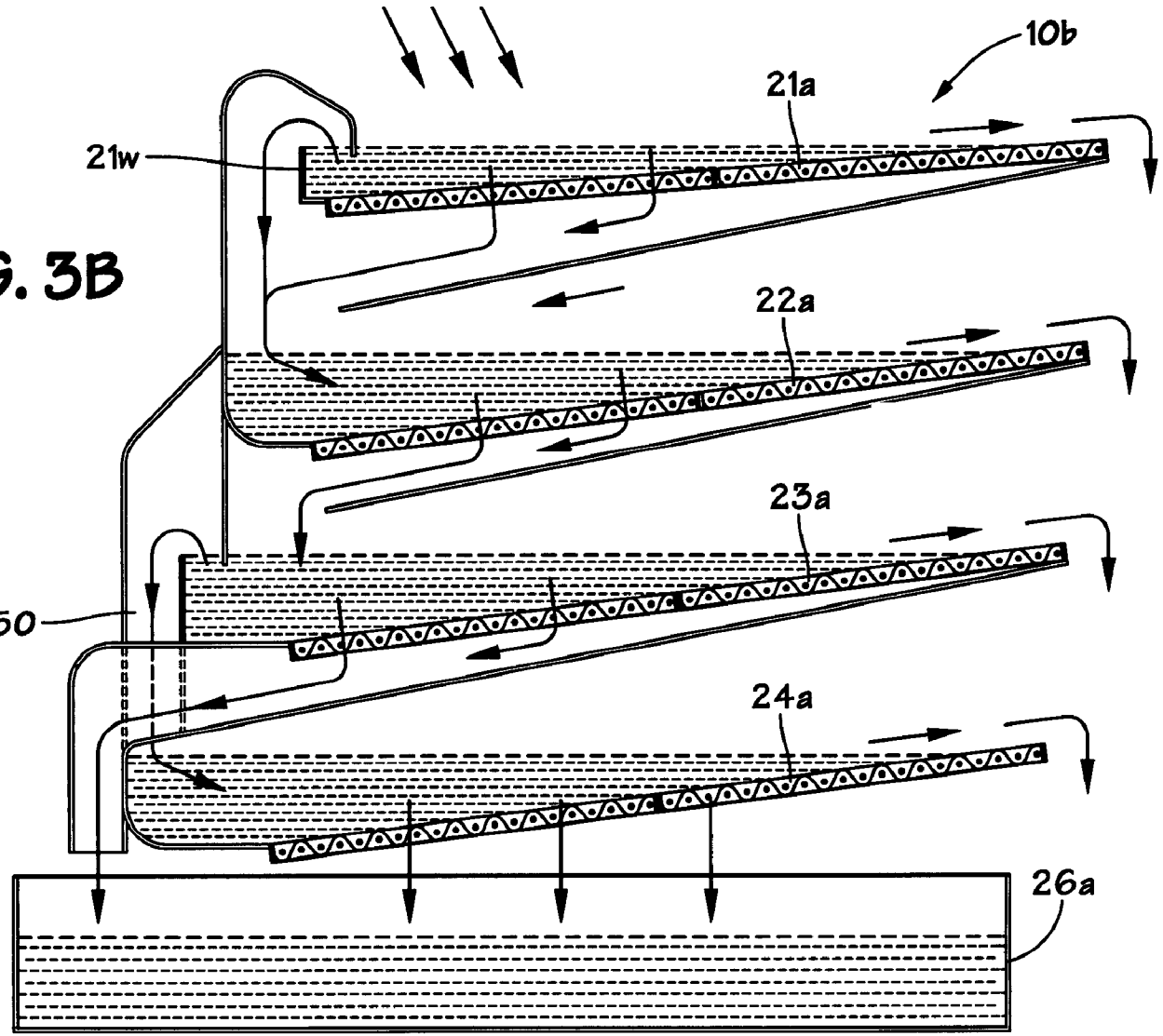
FIG. 3B is a side cutaway view of a shale shaker according to the present invention.

FIGS. 3A and 3B show a shaker system 10*b* like the system 10, FIG. 2A (like numerals indicate like parts). The shaker 10*b* has a collection chute 60 which receives material from top of a screen 21*a* (like the screen 21, FIG. 2A) and from which the material flows down to a cuttings ditch, pit, or collector 19. An auger system 70 receives material from the top of a screen 22*a* (like the screen 22) and augers the material into a conduit 70*a* from which it flows to storage or further processing apparatus 70*b*. The flows from the tops of screens 23*a* (like screen 23) and 24*a* (like screen 24) flow to the cuttings ditch (etc.) 19. Fluid flowing through the screens flows to a sump 26*a* (like the sump 26). In one aspect, the screen 22*a* is used to recover LCM (and/or material of similar size), optionally, as in FIG. 2C, both screens 22*a* and 23*a* are used to recover LCM (and/or material of similar size).

Material recovered from the top of a second screen in systems according to the present invention (e.g. from the top of the screen 8*b*, 21 or 21*a*) can, according to the present invention, be sent to additional treatment apparatus for further processing; including, but not limited to, a sprinkle-wash system for solids recovery, centrifuge(s), hydrocyclone(s), and/or magnetic separation apparatus. This material from the tops of these screens is, in one aspect, lost circulation material. In one aspect, considering the totality (100%) of the lost circulation material in a drilling fluid mixture fed to a top scalping screen of a system according to the present invention, about 97% of this lost circulation material flows to the second screen and about 95% (95% of the original totality of the material) is recovered from the top of the second screen; or optionally, a combination of similar sized material, including both LCM and other material is recovered.

Figure 4A:
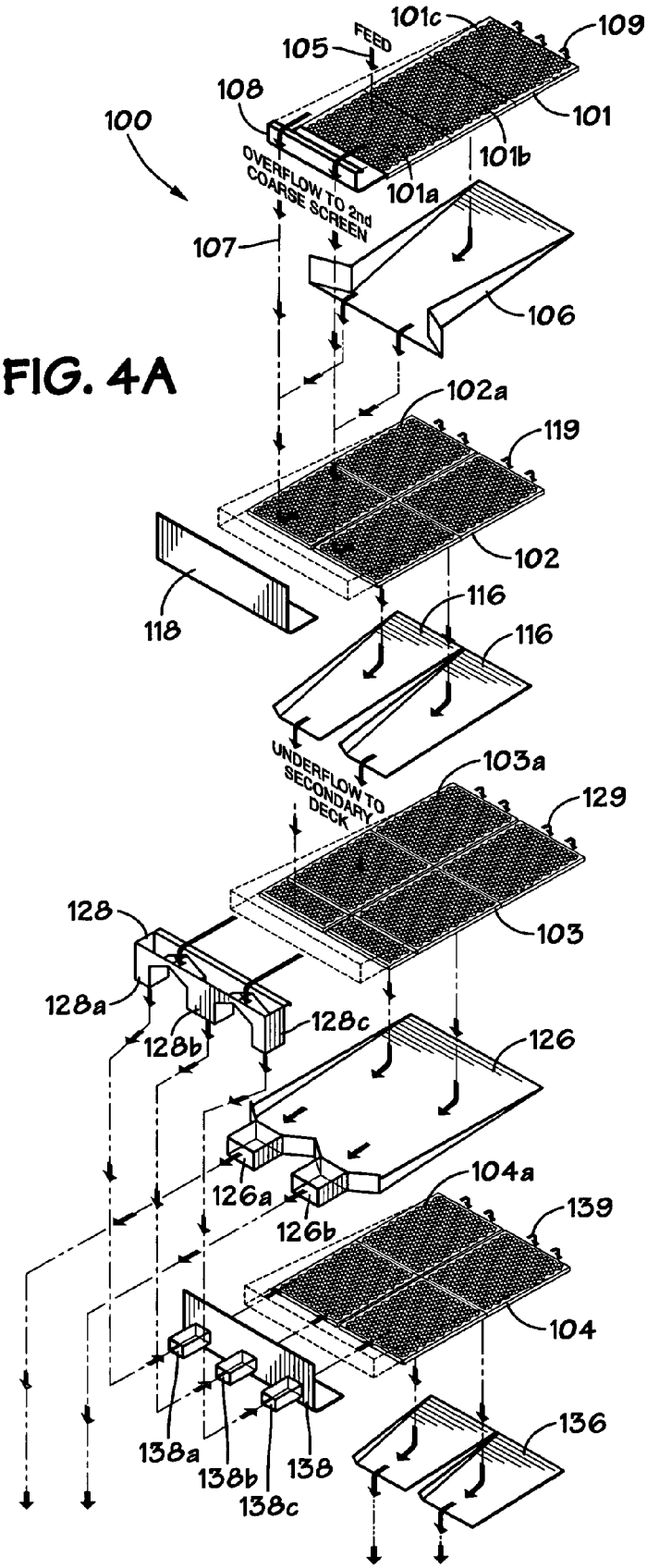
FIG. 4A is a perspective exploded view of a system according to the present invention.
Figure 4B:
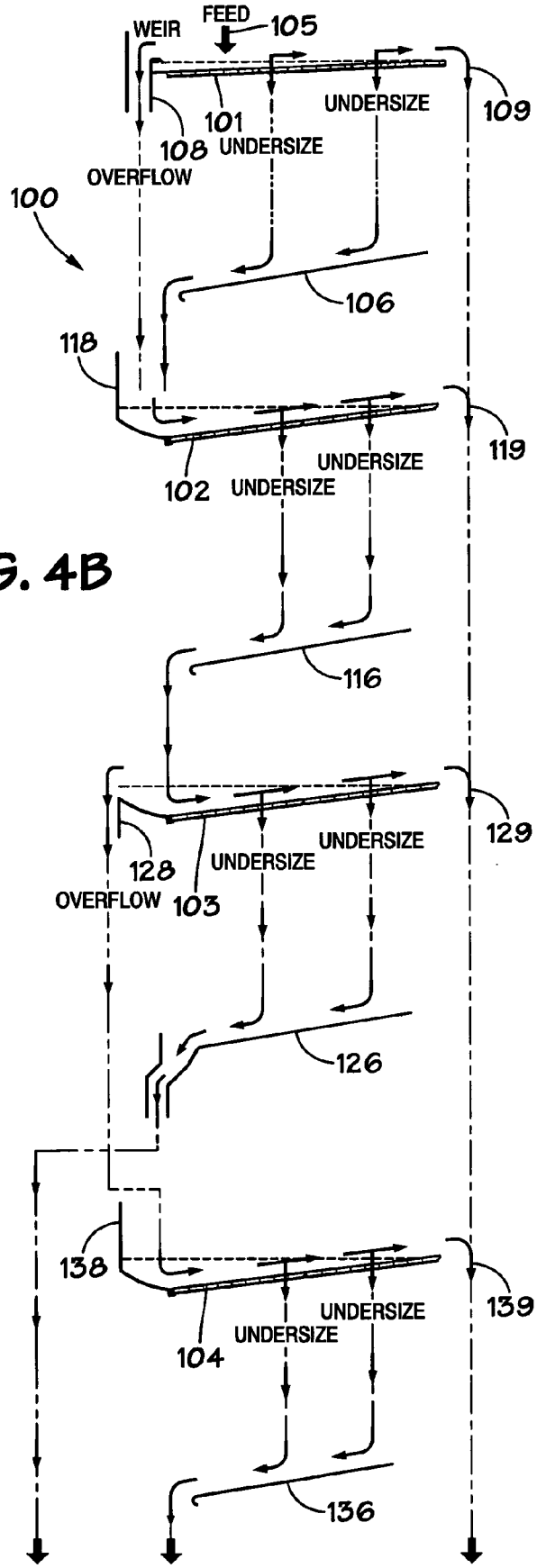
FIG. 4B is a schematic side view of the system of FIG. 4A.

FIGS. 4A and 4B illustrate a quad-tier system 100 according to the present invention which has screen decks 101, 102, 103, and 104. A feed 105 of a drilling fluid mixture is fed onto a first deck 101 with a plurality of screens 101*a*, 101*b*, 101*c* (may be any suitable number of screens). Drilling fluid (with some solids) flowing through the screens 101*a*-101*c* flows to a chute 106 and from there down to the deck 102. Overflow 107 from the deck 101 flows over a weir 108 (of a predetermined height) down to the deck 102. Oversized material 109 flows off the top of the screen 101*c*.

Drilling fluid with some solids flowing through screens 102*a* (four shown; may be any suitable number of screens) flows to chutes 116 and from there to the deck 103. Oversize material 119 flows off the tops of screens 102*a*. A weir 118 prevents any overflow from the top of the screens 102*a* from flowing down to the deck 103.

Drilling fluid with some solids flowing through screens 103*a* (size shown; may be any number) of the deck 103 flows to a diverter 126 and from there to a collection structure, e.g. a tank, sump or receptacle. Overflow from the top of the screens 103*a* flows to a channel apparatus 128 and from there to a channel apparatus 138 which directs this flow to the top of the deck 104. Oversized material 129 flows off the tops of end screens 103*a*.

Drilling fluid flowing through screens 104*a* (four shown; any number may be used) flows down to chutes 136 and then to the tank, sump, or receptacle. Oversized material 139 flows off tops of end screens 104*a*.

The oversized material flows, 109, 119, 129 and 139 flow to typical collection sump, pit tank, or receptacle or storage apparatus and/or to subsequent processing apparatus.

In one particular aspect of the system 100, the deck 101 is a coarse screening deck (e.g. but not limited to the screen 8*a*, screen A1, screen 21 or screen 21*a*); the deck 102 is a medium mesh screening deck (e.g. but not limited to, like the screen 8*b*, screen A2, screen 22, or screen 22*a*); the deck 103 is a medium or fine screening deck (e.g., but not limited to, like the screen 8*c*, screen A3, screen 23 or screen 23*a*); and the deck 104 is a fine screening deck (e.g., but not limited to, like the screen 8*d*, screen A4, screen 24 or screen 24*a*).

Figure 5A:
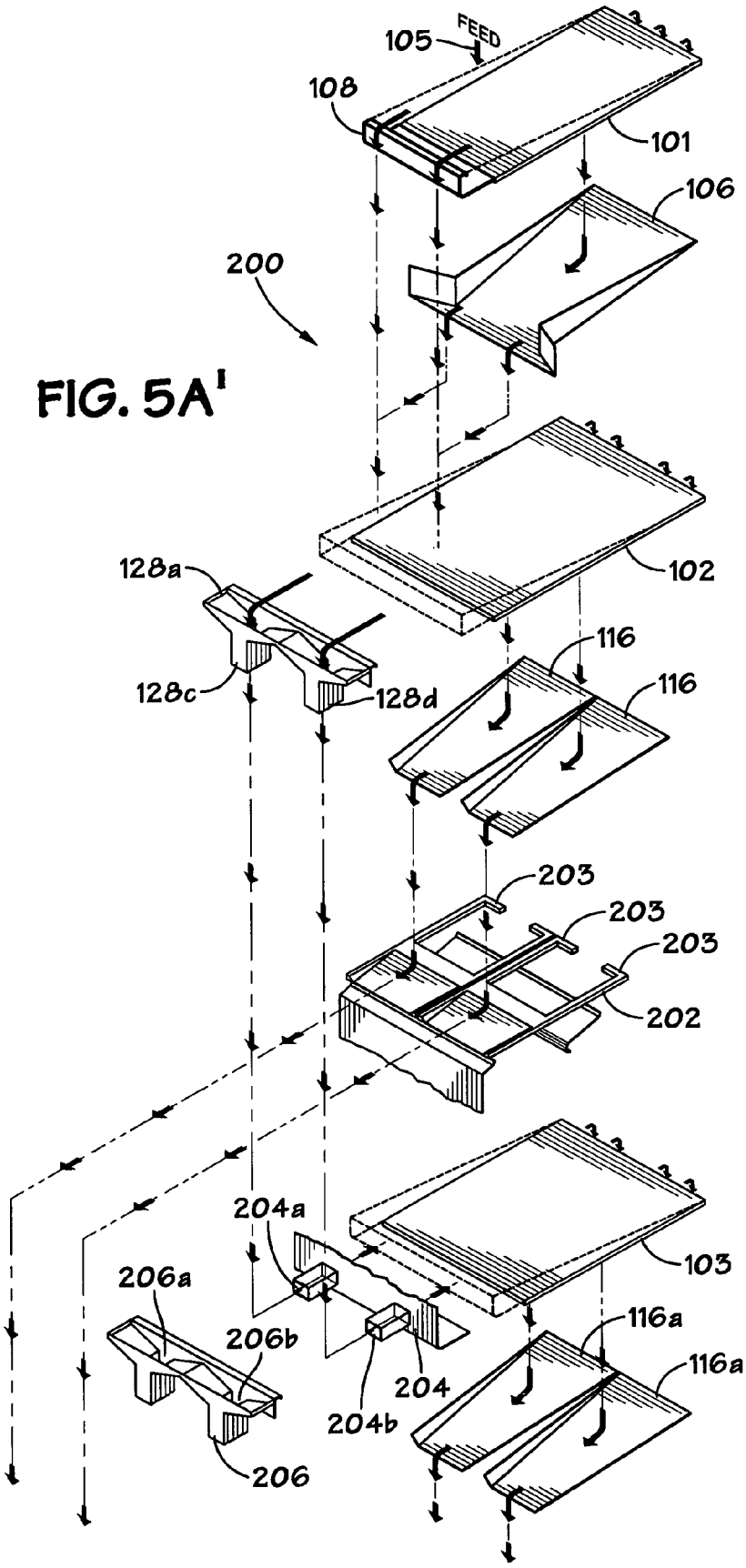
FIG. 5A is a perspective exploded view of a system according to the present invention.
Figure 5A:
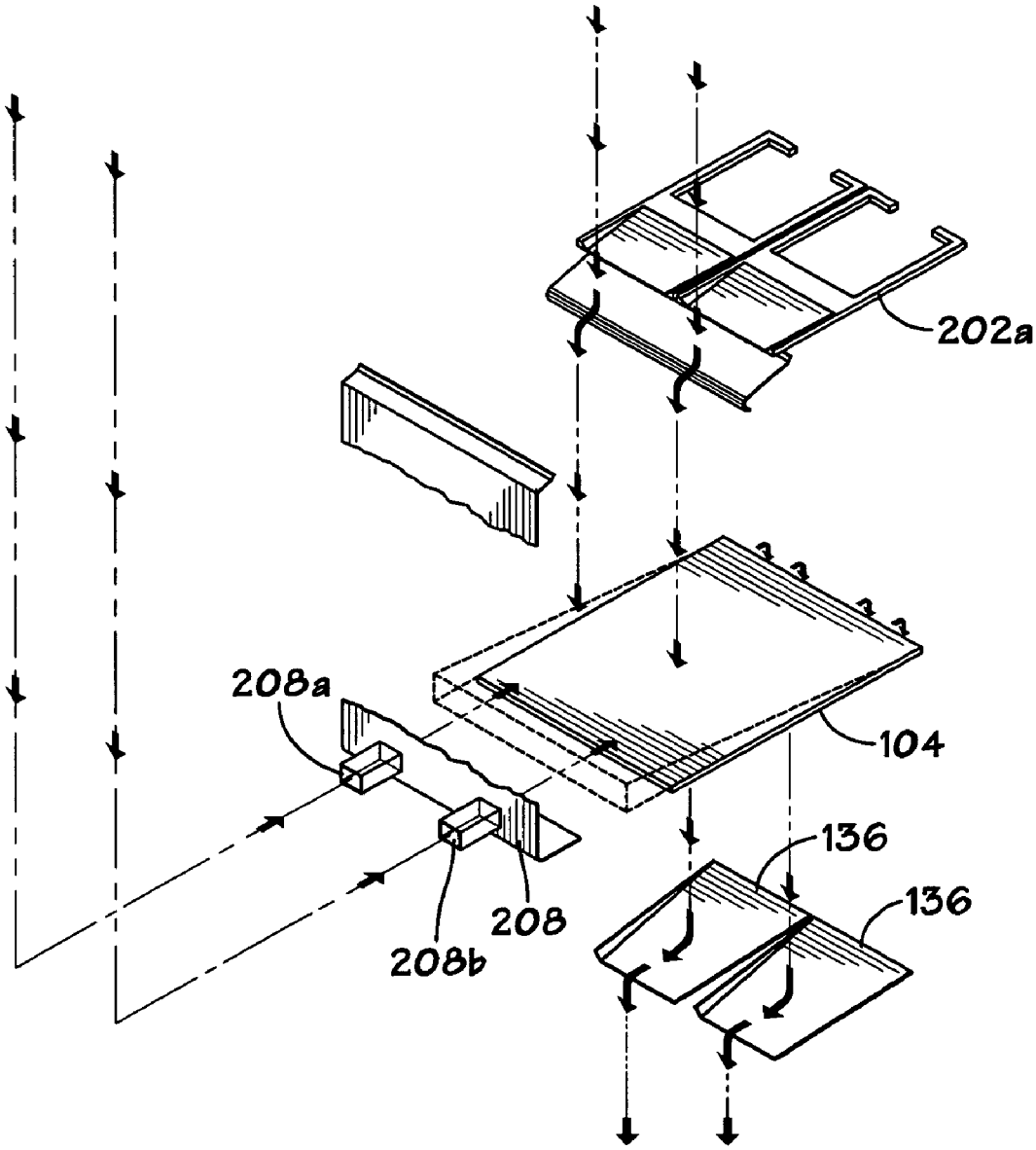
Figure 5B:
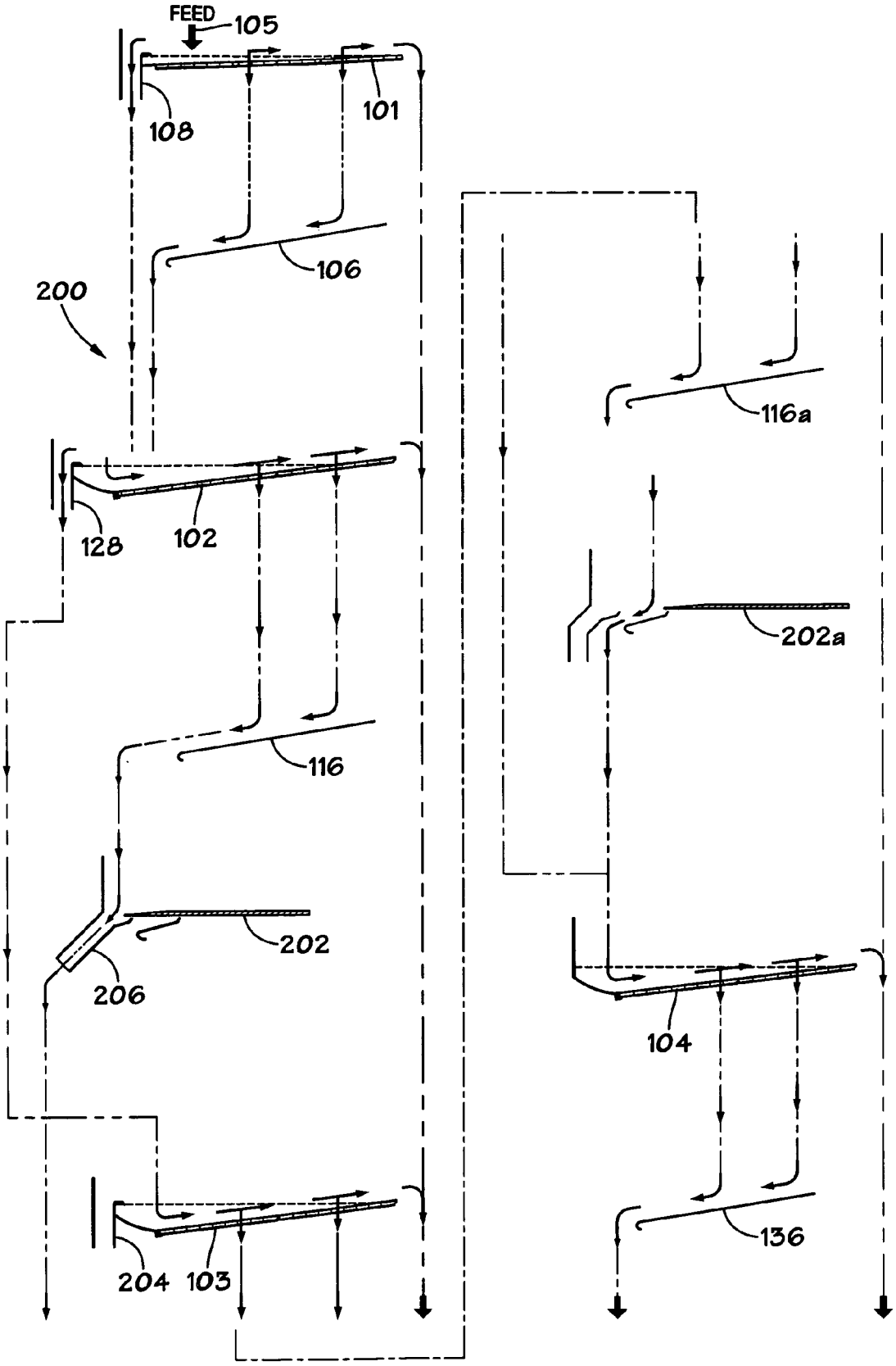
FIG. 5B is a schematic side view of the system of FIG. 5A.

FIGS. 5A and 5B illustrate a system 200 according to the present invention which is, in some ways, like the system 100, FIG. 4A. In the system of FIG. 4A underflow from the deck 102 flows to both the deck 103 and the deck 104. In the system 200 flow from the deck 101 flows to both the deck 102 and the deck 103, with underflow from both of these decks flowing to the deck 104.

Drilling fluid with some solids (underflow from the deck 101) flows from the deck 101 down to the deck 102. Overflow from the deck 102 flows via the channel apparatus 128*a* and channel apparatus 204 to the deck 103. Underflow from the deck 102 flows to the chutes 116 and is diverted to the deck 104 by a diverter 202 (with handles 203) and via a channel apparatus 206 and a channel apparatus 208 to the deck 104. In one aspect the diverter 202 is connected to the channel apparatus 204 (indicated by the wavy lines on both).

Underflow having passed through the deck 103 and chutes 116*a* (like the chutes 116) is diverted by a diverter 202*a* (like the diverter 202) to the deck 104. Underflow having passed through the deck 104 flows to the chutes 136 and then to collection, storage, tank, or receptacle.

The various chutes, diverters, and channel apparatuses in the systems 100 and 200 are interchangeable, in one aspect, so that series or parallel flow to and from one or more selected decks is facilitated. In certain aspects, the chutes, diverters and channel apparatuses are made of metal, plastic, or composite material.

In the system 100, FIG. 4A, the channel apparatus 128 has three flow passages 128*a*, 128*b*, 128*c*. The diverter 126 has two flow passages 126*a*, 126*b*. The channel apparatus 138 has flow passages 138*a*, 138*b*, 138*c*. In the system 200, FIG. 5A, the channel apparatus 128*a* has flow channels 128*c*, 128*d*. The channel apparatus 204 has flow passage 204*a*, 204*b*. The channel apparatus 206 has flow passages 206*a*, 206*b*. The channel apparatus 208 has flow passages 208*a*, 208*b*.

The present invention, therefore, provides in at least certain embodiments, a system for processing a mixture of drilling fluid and solid material to separate at least one component of the mixture by size from the mixture, the system including a vibratable basket; a sump at a bottom of the basket; a plurality of spaced-apart screens including a first screen deck, a second screen deck positioned below the first screen, a third screen deck positioned below the second screen deck, and a fourth screen deck positioned below the third screen; the screens mounted in the vibratable basket and vibratable therewith; the first screen deck having screen mesh of a first size to remove from a top of the first screen deck solids from the mixture with a largest dimension equal to and larger than a first dimension so that material with a largest dimension smaller than the first dimension is passable down through the first screen deck; the second screen deck having screen mesh of a second size to remove from a top of the second screen solids from the mixture passing to the second screen deck from the first screen deck which have a largest dimension equal to or larger than the second size so that material with a largest dimension smaller than the second size is passable down through the second screen deck, material and fluid passing through the second screen deck comprising a secondary flow; diversion apparatus connected to the basket positioned for providing at least a portion of the secondary flow to the third screen deck and, selectively, a portion of the secondary flow to the fourth screen deck; the third screen deck having screen mesh of a third size, and the fourth screen deck having screen mesh of a fourth size for removing solids from the secondary flow on the top of the third screen deck and from the top of the fourth screen deck; and drilling fluid flowing through the first screen deck, the second screen deck and one of the third screen deck and fourth screen deck flowing down into the sump. Such a system may have one or some, in any possible combination, of the features and aspects described above for any system according to the present invention.

The present invention, therefore, provides in at least certain embodiments, a system for processing a mixture of drilling fluid and solid material to separate at least one component of the mixture by size from the mixture, the system including: a vibratable basket; a sump at a bottom of the basket; a plurality of spaced-apart screens including a first screen deck, a second screen deck positioned below the first screen, a third screen deck positioned below the second screen deck, and a fourth screen deck positioned below the third screen; the screens mounted in the vibratable basket and vibratable therewith; the first screen deck having screen mesh of a first size to remove from a top of the first screen solids from the mixture with a largest dimension equal to and larger than a first dimension so that material with a largest dimension smaller than the first dimension is passable down through the first screen deck; the second screen deck having screen mesh of a second size to remove from a top of the second screen solids from the mixture passing to the second screen deck from the first screen deck which have a largest dimension equal to or larger than the second size so that material with a largest dimension smaller than the second size is passable down through the second screen deck, material and fluid passing through the second screen deck comprising a secondary flow; diversion apparatus connected to the basket positioned for providing at least a portion of the secondary flow to the third screen deck and, selectively, a portion of the secondary flow to the fourth screen deck; the third screen deck having screen mesh of a third size, and the fourth screen deck having screen mesh of a fourth size for removing solids from the secondary flow on the top of the third screen deck and from the top of the fourth screen deck; drilling fluid flowing through the first screen deck, the second screen deck and one of the third screen deck and fourth screen-deck flowing-down into the sump; wherein the first screen deck is a scalping deck; wherein the screen mesh of a second size is suitable for removing solids the size of lost circulation material, said solids including pieces of lost circulation material and pieces of material other than lost circulation material; the drilling fluid mixture introduced to the system to be treated by the system includes a first amount of lost circulation material; the second deck is able to remove a second amount of lost circulation material; the second amount at least 75% of the first amount; and reclamation apparatus for receiving the lost circulation material.

The present invention, therefore, provides in at least certain embodiments, a method for treating a mixture of drilling fluid and solid material to separate at least one component of the mixture by size from the mixture, the method including: feeding the mixture to a vibratable basket of a system, the system as any described herein according to the present invention, and the method further including flowing drilling fluid through a first screen deck, a second screen deck and one of a third screen deck and a fourth screen deck of the system down into a sump; or flowing drilling fluid through a first screen deck, and one of a second screen deck and a third screen deck flowing down into a sump.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

What is claimed is:

1. A system that is adapted for separating a mixture comprising drilling fluid and solids material, said system comprising:

a first screen deck that is adapted to receive a flow of said mixture and separate at least a first portion of said flow of said mixture into a first separated solids portion and a first screen outflow comprising drilling fluid and a first unseparated solids portion;

a second screen deck that is arranged in a series flow configuration with said first screen deck, wherein said second screen deck is positioned below said first screen deck and is adapted to receive said first screen outflow and separate said first screen outflow into a second separated solids portion and a second screen outflow comprising drilling fluid and a second unseparated solids portion;

a third screen deck that is positioned below said second screen deck and is adapted to receive said second screen outflow and separate at least a first portion of said second screen outflow into a third separated solids portion and a third screen outflow comprising drilling fluid and a third unseparated solids portion;

a fourth screen deck that is arranged in a parallel flow configuration with said third screen deck, wherein said fourth screen deck is positioned below said third screen deck and is adapted to receive at least a second portion of said second screen outflow and separate said at least said second portion into a fourth separated solids portion and a fourth screen outflow comprising drilling fluid and a fourth unseparated solids portion;

a first flow diversion apparatus comprising a first overflow weir and a first flow channel apparatus, wherein said first flow diversion apparatus is adapted to create said parallel flow configuration between said third and fourth screen decks; and a second flow diversion apparatus comprising a second flow channel apparatus, wherein said second flow diversion apparatus is adapted to divert said third screen outflow so as to bypass said fourth screen deck.

2. The system of claim 1, wherein said first screen deck comprises a first screen mesh comprising a first mesh size that is adapted to separate solids material of a first size having a largest dimension equal to or larger than a first specified dimension from said flow of said mixture and to permit drilling fluid and solids material having a largest dimension smaller than said first specified dimension to pass therethrough.

3. The system of claim 2, wherein said second screen deck comprises a second screen mesh comprising a second mesh size that is adapted to separate solids material of a second size having a largest dimension equal to or larger than a second specified dimension from said first screen outflow and to permit drilling fluid and solids material having a largest dimension smaller than said second specified dimension to pass therethrough.

4. The system of claim 3, wherein said second screen mesh is adapted to separate and remove lost circulation material.

5. The system of claim 3, wherein said second screen mesh is adapted to permit solids material having a largest dimension of 1/16inch or smaller to pass therethrough.

6. The system of claim 3, wherein said second screen deck is adapted to separate and remove at least 75% of said solids material of said second size.

7. The system of claim 3, wherein said second screen deck is adapted to separate and remove at least 95% of said solids material of said second size.

8. The system of claim 3, wherein said third screen deck comprises a third screen mesh comprising a third mesh size that is adapted to separate solids material of a third size having a largest dimension equal to or larger than a third specified dimension from said at least said first portion of said second screen outflow and to permit drilling fluid and solids material having a largest dimension smaller than said third specified dimension to pass therethrough.

9. The system of claim 8, wherein said fourth screen deck comprises a fourth screen mesh comprising a fourth mesh size that is adapted to separate solids material of a fourth size having a largest dimension equal to or larger than a fourth specified dimension from said at least said second portion of said second screen outflow and to permit drilling fluid and solids material having a largest dimension smaller than said fourth specified dimension to pass therethrough.

10. The system of claim 9, wherein said second mesh size is smaller than said first mesh size, and said third and fourth mesh sizes are smaller than said second mesh size.

11. The system of claim 10, wherein said fourth mesh size is smaller than said third mesh size.

12. The system of claim 1, further comprising a vibratable basket, wherein said first, second, third and fourth screen decks are mounted in said vibratable basket and are adapted to be vibrated therewith.

13. The system of claim 1, wherein said first flow channel apparatus comprises at least one substantially vertical flow passage that is adapted to direct said at least said second portion of said second screen outflow to at least one substantially horizontal flow passage that is adapted to direct said at least said second portion to said fourth screen deck.

14. The system of claim 1, wherein said second flow channel apparatus comprises at least one substantially horizontal flow passage that is adapted to direct said third screen outflow to at least one substantially vertical flow passage that is adapted to direct said third screen outflow to a sump positioned below said fourth screen deck, wherein said sump is adapted to receive a combined flow of said third and fourth screen outflows.

15. The system of claim 1, further comprising a reclamation apparatus adapted to receive reclamation material comprising separated solids from at least one of said first, second, third and fourth screen decks.

16. The system of claim 15, further comprising an auger apparatus adapted to move reclamation material comprising separated solids from at least one of said first, second, third and fourth screen decks to said reclamation apparatus.

17. The system of claim 1, wherein said first screen deck comprises a second overflow weir that is adapted to permit at least a second portion of said flow of said mixture to bypass said first screen deck.

18. The system of claim 1, wherein at least one of said first, second, third and fourth screen decks comprises a flow chute positioned therebelow.

19. A system that is adapted for separating a mixture comprising drilling fluid and solids material, said system comprising:

a first screen deck that is adapted to receive a flow of said mixture and separate said flow of said mixture into a first separated solids portion and a first screen outflow comprising drilling fluid and a first unseparated solids portion;

a second screen deck that is positioned below said first screen deck and is adapted to receive said first screen outflow and separate at least a first portion of said first screen outflow into a second separated solids portion and a second screen outflow comprising drilling fluid and a second unseparated solids portion;

a third screen deck that is arranged in a parallel flow configuration with said second screen deck, wherein said third screen deck is positioned below said second screen deck and is adapted to receive at least a second portion of said first screen outflow and separate said at least said second portion into a third separated solids portion and a third screen outflow comprising drilling fluid and a third unseparated solids portion;

a fourth screen deck that is arranged in a series flow configuration with a combination of said second and third screen decks, wherein said fourth screen deck is positioned below said third screen deck and is adapted to receive a combined flow of said second and third screen outflows from said second and third screen decks, respectively, and separate said combined flow into a fourth separated solids portion and a fourth screen outflow comprising drilling fluid and a fourth unseparated solids portion;

a first flow diversion apparatus comprising an overflow weir and a first flow channel apparatus, wherein said first flow diversion apparatus is adapted to create said parallel flow configuration between said second and third screen decks; and a second flow diversion apparatus comprising a second flow channel apparatus, wherein said second flow diversion apparatus is adapted to create said series flow configuration between said combination of said second and third screen decks and said fourth screen deck.

20. The system of claim 19, wherein said first screen deck comprises a first screen mesh comprising a first mesh size that is adapted to separate solids material of a first size having a largest dimension equal to or larger than a first specified dimension from said flow of said mixture and to permit drilling fluid and solids material having a largest dimension smaller than said first specified dimension to pass therethrough, wherein said second screen deck comprises a second screen mesh comprising a second mesh size that is adapted to separate solids material of a second size having a largest dimension equal to or larger than a second specified dimension from said at least said first portion of said first screen outflow and to permit drilling fluid and solids material having a largest dimension smaller than said second specified dimension to pass therethrough, wherein said third screen deck comprises a third screen mesh comprising a third mesh size that is adapted to separate solids material of a third size having a largest dimension equal to or larger than a third specified dimension from said at least said second portion of said second screen outflow and to permit drilling fluid and solids material having a largest dimension smaller than said third specified dimension to pass therethrough, and wherein said fourth screen deck comprises a fourth screen mesh comprising a fourth mesh size that is adapted to separate solids material of a fourth size having a largest dimension equal to or larger than a fourth specified dimension from said second and third screen outflows and to permit drilling fluid and solids material having a largest dimension smaller than said fourth specified dimension to pass therethrough.

21. The system of claim 20, wherein said second and third mesh sizes are smaller than said first mesh size and said fourth mesh size is smaller than each of said second and third mesh sizes.

22. The system of claim 21, wherein said third mesh size is smaller than said second mesh size.

23. The system of claim 19, wherein said second flow diversion apparatus is adapted to divert said second screen outflow so as to bypass said third screen deck.

24. The system of claim 19, further comprising:

a vibratable basket, wherein said first, second, third and fourth screen decks are mounted in said vibratable basket and are adapted to be vibrated therewith; and a sump positioned below said vibratable basket, wherein said sump is adapted to receive said fourth screen outflow.

25. A system that is adapted for separating a mixture comprising drilling fluid and solids material, said system comprising:

a first screen deck that is adapted to receive a flow of said mixture and remove a first portion of said solids material therefrom;

a second screen deck that is arranged in series flow configuration with said first screen deck, wherein said second screen deck is adapted to receive a flow of a first effluent mixture leaving said first screen deck and remove a second portion of said solids material therefrom;

a third screen deck that is adapted to receive a flow of a second effluent mixture leaving said second screen deck and remove a third portion of said solids material from at least a first portion of said flow of said second effluent mixture;

a fourth screen deck that is arranged in a parallel flow configuration with said third screen deck, wherein said fourth screen deck is adapted to receive at least a second portion of said flow of said second effluent mixture and remove a fourth portion of said solids material therefrom;

a first flow diversion apparatus comprising an overflow weir and a first flow channel apparatus, wherein said first flow diversion apparatus is adapted to create said parallel flow configuration between said third and fourth screen decks; and a second flow diversion apparatus comprising a second flow channel apparatus, wherein said second flow diversion apparatus is adapted to divert a flow of a third effluent mixture leaving said third screen deck so as to bypass said fourth screen deck.

26. A system that is adapted for separating a mixture comprising drilling fluid and solids material, said system comprising:

a first screen deck that is adapted to receive a flow of said mixture and remove a first portion of said solids material therefrom;

a second screen deck that is adapted to receive a flow of a first effluent mixture leaving said first screen deck and remove a second portion of said solids material from at least a first portion of said flow of said first effluent mixture;

a third screen deck that is configured in parallel flow with said second screen deck, wherein said third screen deck is adapted to receive at least a second portion of said flow of first effluent mixture and remove a third portion of said solids material therefrom;

a fourth screen deck that is adapted to receive a flow of a second effluent mixture leaving said second screen deck and a flow of a third effluent mixture leaving said third screen deck and remove a fourth portion of said solids material therefrom, wherein said flows of said second and third effluent mixtures from said second and third screen decks, respectively, to said fourth screen deck is configured to be in series;

a first flow diversion apparatus comprising an overflow weir and a first flow channel apparatus, wherein said first flow diversion apparatus is adapted to create said parallel flow of said at least said first and second portions of said flow of said first effluent mixture;

a second flow diversion apparatus comprising a second flow channel apparatus, wherein said second flow diversion apparatus is adapted to divert said flow of said second effluent mixture leaving said second screen deck so as to bypass said third screen deck.

* * * * *